US007293303B2

(12) United States Patent
Worrell

(10) Patent No.: US 7,293,303 B2
(45) Date of Patent: Nov. 13, 2007

(54) METHOD AND DEVICE FOR REPOSITIONING PATIENT IN BED WITH SAFETY FEATURES

(76) Inventor: Gregory A. Worrell, 4816 W. 5th St., Greeley, CO (US) 80634

( * ) Notice: Subject to any disclaimer, the term of this patent is extended or adjusted under 35 U.S.C. 154(b) by 133 days.

(21) Appl. No.: 10/853,636

(22) Filed: May 24, 2004

(65) Prior Publication Data

US 2004/0231050 A1 Nov. 25, 2004

Related U.S. Application Data

(60) Provisional application No. 60/527,953, filed on Dec. 8, 2003, provisional application No. 60/472,977, filed on May 22, 2003.

(51) Int. Cl.
*A61G 7/08* (2006.01)
*A61G 7/10* (2006.01)

(52) U.S. Cl. ..... 5/81.1 R; 5/88.1; 5/84.1; 5/81.1 HS

(58) Field of Classification Search ..... 5/81.1 R, 5/83.1–85.1, 88.1, 89.1, 81.1 HS, 81.1 C, 5/81.1 T
See application file for complete search history.

(56) References Cited

U.S. PATENT DOCUMENTS

| | | | | |
|---|---|---|---|---|
| 67,610 A | | 8/1867 | Teal | 5/600 |
| 266,167 A | * | 10/1882 | Leslie | 5/84.1 |
| 548,778 A | | 10/1895 | Douglas | 5/88.1 |
| 659,755 A | | 10/1900 | Moulton | 5/88.1 |
| 1,082,177 A | | 12/1913 | Skeffington | 5/88.1 |
| 1,085,879 A | | 2/1914 | Skeffington | 5/88.1 |
| 1,334,901 A | | 4/1920 | Higdon | 5/500 |
| 1,795,435 A | | 4/1931 | Melzer | 5/627 |
| 1,985,879 A | | 1/1935 | Boehnke | 100/58 |
| 2,812,524 A | | 11/1957 | Pruitt | 5/61 |
| 2,827,642 A | | 5/1958 | Huff | 5/317 |
| 3,284,816 A | | 11/1966 | Laubsch | 5/81 |
| 3,364,506 A | | 1/1968 | Hale | 5/81 |
| 3,383,717 A | | 5/1968 | Underwood | 5/61 |
| 3,597,774 A | | 8/1971 | Warren | 5/84 |
| 3,829,914 A | | 8/1974 | Treat | 5/81 |
| 3,849,813 A | | 11/1974 | Neilson | 5/334 |
| 3,886,605 A | | 6/1975 | Harris | 5/81 |
| 3,962,736 A | | 6/1976 | Fedele | 5/81 |
| 4,051,565 A | | 10/1977 | Berge | 5/81 |
| 4,156,946 A | | 6/1979 | Attenburrow | 5/81 |
| 4,202,064 A | | 5/1980 | Joergensen | 5/83 |

(Continued)

OTHER PUBLICATIONS

EZ Repositioner, EZ Way Inc., www.ezlifts.com, Dec. 2001.

(Continued)

*Primary Examiner*—Robert G. Santos
(74) *Attorney, Agent, or Firm*—Sheridan Ross P.C.

(57) ABSTRACT

The invention described is a device and method for repositioning a patient in a bed. Bedding material positioned underneath the patient is wound by a ratchet system and a crossbeam that allows for the patient to be repositioned when the bedding material is drawn around the crossbeam. The patient is moved without physical contact or being lifted by patient caregivers. In one embodiment, the device allows for the patient to be repositioned by a single operator caregiver. In another embodiment, the device can be quickly removed from the patient's bed.

14 Claims, 13 Drawing Sheets

U.S. PATENT DOCUMENTS 4,226,608 A * 10/1980 McKelvey ..... 65/106
4,306,711 A * 12/1981 Van Malderghem et al. ..... 270/57.11
4,327,453 A 5/1982 Sefton ..... 5/81.1
4,536,903 A 8/1985 Parker ..... 5/61
4,611,539 A * 9/1986 Ireton ..... 101/401.1
4,680,818 A 7/1987 Ooka et al. ..... 5/81
4,747,170 A 5/1988 Knouse ..... 5/81.1
4,799,273 A 1/1989 Elze ..... 5/81
4,843,665 A * 7/1989 Cockel et al. ..... 5/88.1
4,868,938 A 9/1989 Knouse ..... 5/81
5,018,225 A * 5/1991 Fergni et al. ..... 5/607
5,054,140 A * 10/1991 Bingham et al. ..... 5/600
5,280,657 A * 1/1994 Stagg ..... 5/81.1 R
D346,346 S 4/1994 Johnson et al. ..... D12/128
5,340,266 A * 8/1994 Hodgetts ..... 414/527
5,511,255 A 4/1996 Schuerch ..... 5/81.1
5,511,256 A 4/1996 Capaldi ..... 5/83.1
5,530,974 A 7/1996 Rains et al. ..... 5/81.1
5,540,321 A 7/1996 Foster ..... 198/510.1
5,560,053 A 10/1996 Miller ..... 5/81.1
5,579,546 A 12/1996 Griskauskas ..... 5/81.1
5,579,547 A 12/1996 Hunt ..... 5/86.1
RE35,468 E 3/1997 Newman ..... 5/81.1
5,615,426 A 4/1997 Hokett ..... 5/39.1
5,694,654 A 12/1997 Roy ..... 5/83.1
5,697,109 A * 12/1997 Hodgetts ..... 5/81.1 R
5,711,044 A 1/1998 Newman et al. ..... 5/81.1
5,737,781 A 4/1998 Votel ..... 5/81.1
D395,852 S 7/1998 DiTommaso ..... D12/128
5,809,591 A 9/1998 Capaldi et al. ..... 5/83.1
D402,434 S 12/1998 Votel ..... D34/28
5,860,174 A 1/1999 Failor ..... 5/81.1
5,875,501 A 3/1999 Jury ..... 5/81.1
5,890,238 A 4/1999 Votel ..... 5/81.1
5,901,388 A 5/1999 Cowan ..... 5/81.1
5,915,911 A 6/1999 Hodgetts ..... 414/527
5,920,929 A 7/1999 Hensley et al. ..... 5/81.1
5,966,754 A 10/1999 Schuster ..... 5/81.1
5,996,144 A 12/1999 Hodgetts ..... 5/81.1
5,996,150 A 12/1999 Blevins et al. ..... 5/613
6,006,375 A 12/1999 Carr ..... 4/613
6,026,525 A 2/2000 Davis ..... 5/99.1
6,035,465 A 3/2000 Rogozinski ..... 5/83.1
6,201,195 B1 3/2001 Carey ..... 177/144
6,282,734 B1 * 9/2001 Holberg ..... 5/81.1 HS
6,289,533 B1 9/2001 Hodgetts ..... 5/81.1
6,289,534 B1 9/2001 Hakamium et al. ..... 5/89.1
6,308,981 B1 10/2001 Proehl ..... 280/657
6,408,466 B1 * 6/2002 Blotta ..... 5/625
6,496,991 B1 * 12/2002 Votel ..... 5/81.1 HS
6,507,963 B2 * 1/2003 Hodgetts ..... 5/81.1 R
6,591,435 B1 * 7/2003 Hodgetts ..... 5/88.1
6,615,423 B2 * 9/2003 Sverdlik et al. ..... 5/81.1 C
6,629,323 B2 * 10/2003 Sverdlik et al. ..... 5/81.1 C
6,651,281 B1 * 11/2003 Figiel ..... 5/612
6,662,388 B2 * 12/2003 Friel et al. ..... 5/86.1
6,772,456 B2 * 8/2004 Votel ..... 5/81.1 R
7,003,819 B2 * 2/2006 Weigand ..... 5/81.1 HS
7,062,803 B2 * 6/2006 McMahan ..... 5/81.1 HS
7,111,338 B2 * 9/2006 Faux et al. ..... 5/81.1 HS
2001/0044957 A1 * 11/2001 Hodgetts ..... 5/81.1 R
2002/0029418 A1 * 3/2002 Votel ..... 5/81.1 RP
2002/0083521 A1 * 7/2002 Sverdlik et al. ..... 5/81.1 R
2002/0083522 A1 * 7/2002 Sverdlik et al. ..... 5/81.1 R
2003/0110559 A1 * 6/2003 Weigand ..... 5/81.1 R
2003/0110560 A1 * 6/2003 Friel et al. ..... 5/86.1
2004/0231050 A1 * 11/2004 Worrell ..... 5/81.1 R
2005/0138727 A1 * 6/2005 Faux et al. ..... 5/81.1 R
2005/0155149 A1 * 7/2005 Pedersen ..... 5/81.1 R
2005/0235415 A1 * 10/2005 Pedersen et al. ..... 5/81.1 R
2006/0230527 A1 * 10/2006 McMahan ..... 5/81.1 R
2007/0094790 A1 * 5/2007 Bloomquist ..... 5/81.1 R

OTHER PUBLICATIONS

Loadhandler, www.loadhandler.com, Dec. 1996.

* cited by examiner

METHOD AND DEVICE FOR REPOSITIONING PATIENT IN BED WITH SAFETY FEATURES

This application claims the benefit of U.S. provisional patent application Ser. No. 60/472,977, filed May 22, 2003, and U.S. provisional patent application Ser. No. 60/527,953, filed Dec. 8, 2003, both of which are incorporated by reference in their entirety herein.

FIELD OF THE INVENTION

The present invention is generally directed to a method and device to reposition a patient in a bed.

BACKGROUND OF THE INVENTION

In the health care field, significant physical labor is used to reposition patients in their beds. Traditional methods have required patient caregivers to lift, pull, or even drag a patient into a new desired position in a bed. Because of this physical contact there may be injury to the patient, as well as occupational injury, such as back pain, to the patient caregivers. Other methods have included the use of stretchers, pulleys, and moveable sheets. Each of these methods, however, is inefficient due to the number of patient caregivers required to perform the task or the requirement of cumbersome devices to pull and/or drag patients.

Health care costs and injury to health care personnel and patients may be reduced if patients could be easily moved since some bedridden patients must be moved frequently due to the risk ill effects prolonged bed stay, such as bed sores and spinal trauma. For example, patients with certain treatment regimens must be moved hourly, thus creating logistical problems and inefficiencies related to the utilization of patient caregiver staff. In addition, patients may be reluctant to ask for assistance, knowing that it may be cumbersome to the patient caregiver staff.

One drawback of prior art devices in the field of patient management is that they are generally not capable of positioning a patient in a bed without undue stress to the patient. Furthermore, such devices often require more than one patient caregiver to effectively facilitate the positioning of a patient. Such devices typically rely upon mechanisms that do not provide mechanical advantage or that require large areas to operate, and generally are directed to moving a patient above the bed mattress or laterally rather than longitudinally in relation to the bed. Prior art devices are also expensive, are not mobile, and are not easily attachable/retrofitable to current hospital beds.

For example, U.S. Pat. No. 1,334,901 to Highdon, discloses a reinforced bed sheet with a pad so that a patient may be moved to his side but does not offer longitudinal mobility. U.S. Pat. No. 2,815,524 to Pruitt discloses a device wherein a long bed sheet is rolled laterally by a handle but again does not offer longitudinal mobility or a mechanism to provide mechanical advantage. U.S. Pat. No. 3,597,774 to Warren discloses a device using an adjustable post and winch with a harness to move a patient by pulling underneath the patient's armpits. U.S. Pat. No. 4,799,273 to Elze discloses an apparatus for moving a patient in a bed but requires special assembly in conjunction with special sheets and mattresses.

Thus, there is a long felt need for an effective, economically practical device and method for repositioning patients in a bed that provides longitudinal mobility and easy integration with current hospital beds.

SUMMARY OF INVENTION

It is one aspect of the present invention to provide a patient repositioning apparatus. More specifically, one embodiment of the present invention is directed to a patient repositioning apparatus comprising first and second vertical supports with a frame attachment ends and connector ends. The frame attachment ends have at least two prongs for interconnection to a bed frame. A first crossbeam is interconnected to the first vertical support connector end and the second vertical support connector end. The first crossbeam of one embodiment includes sockets welded or otherwise connected to each of its ends. A ratcheting mechanism is interconnected to the sockets that facilitates rotational of movement of the first crossbeam. One embodiment of the present invention employs vertical support connector ends that have nylon bushings, however other friction reducing materials or mechanisms such as Polytetrafluoroethylene, Teflon, plastic, grease or other lubricators, linear bearings, spherical bearings, etc. may be employed without departing from the scope of the invention In addition, in some embodiments of the invention each first crossbeam end is capable of receiving a screw lock circular end cap in order to secure the first crossbeam to the vertical supports. In operation of one embodiment of the present invention, bedding material is attached to the first crossbeam by using a second crossbeam. A patient then lies on the bedding material and the first crossbeam is rotated using the ratcheting mechanism, thus winding the bedding onto the first crossbeam and causing the patient to be moved to a desired position.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention.

Figure 1A:
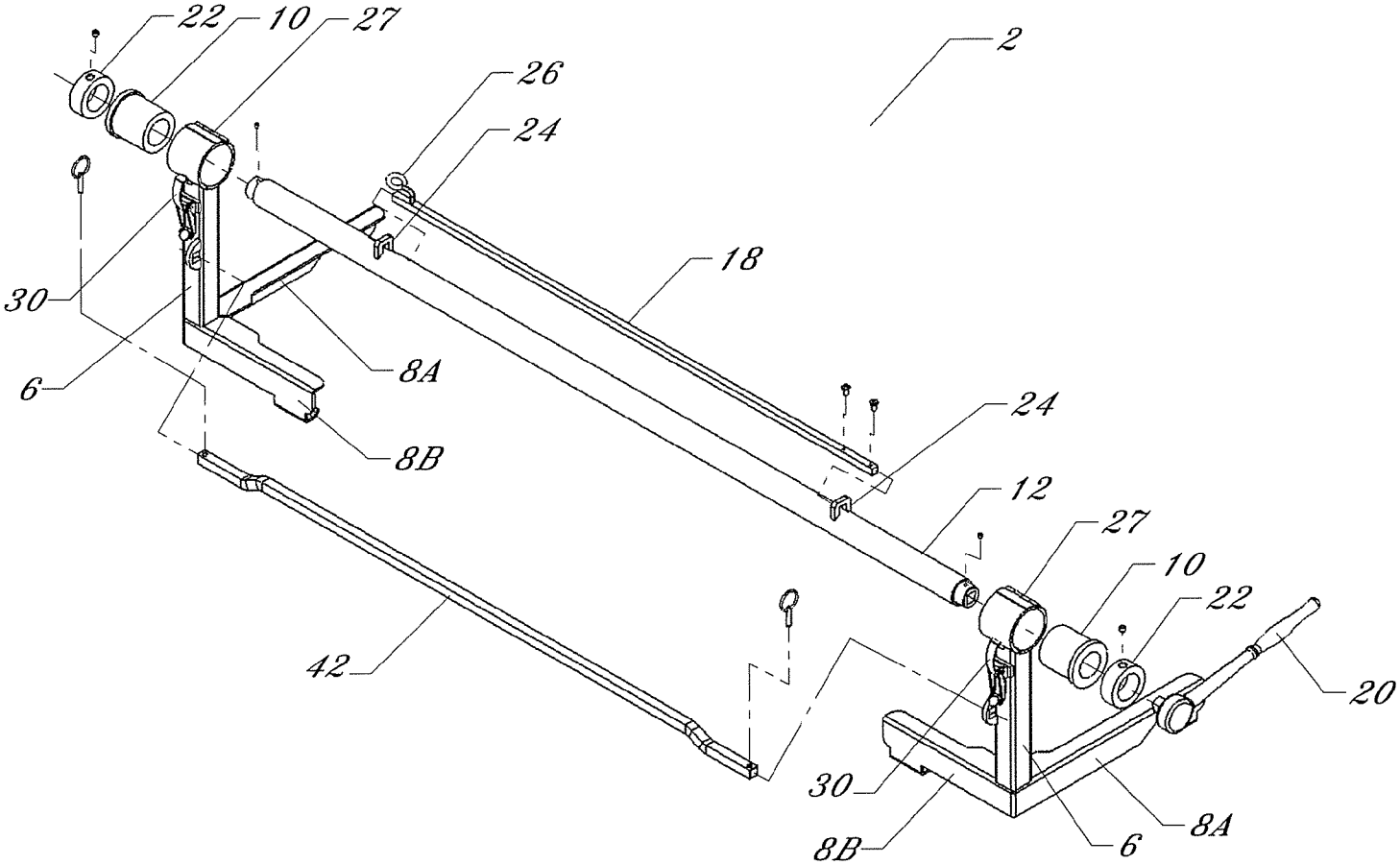
FIG. 1 A is an exploded perspective view of one embodiment of the present invention.
FIG. 1B is a perspective view of one embodiment of the present invention.
Figure 1B:
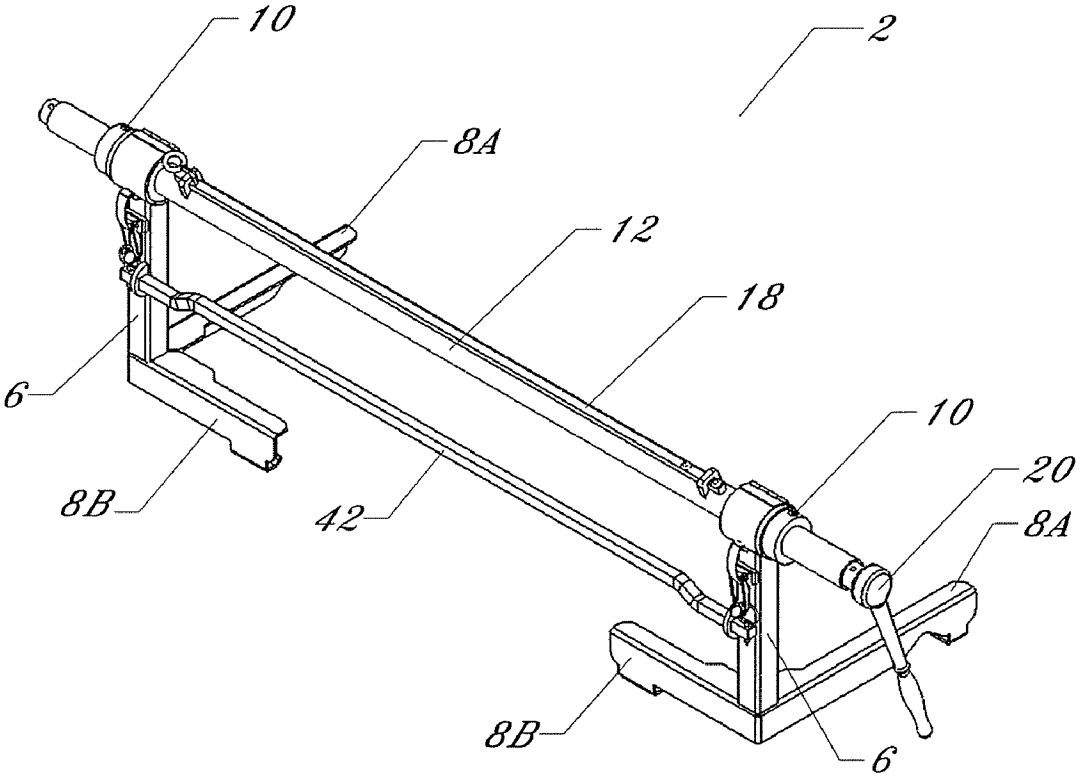
Figure 2:
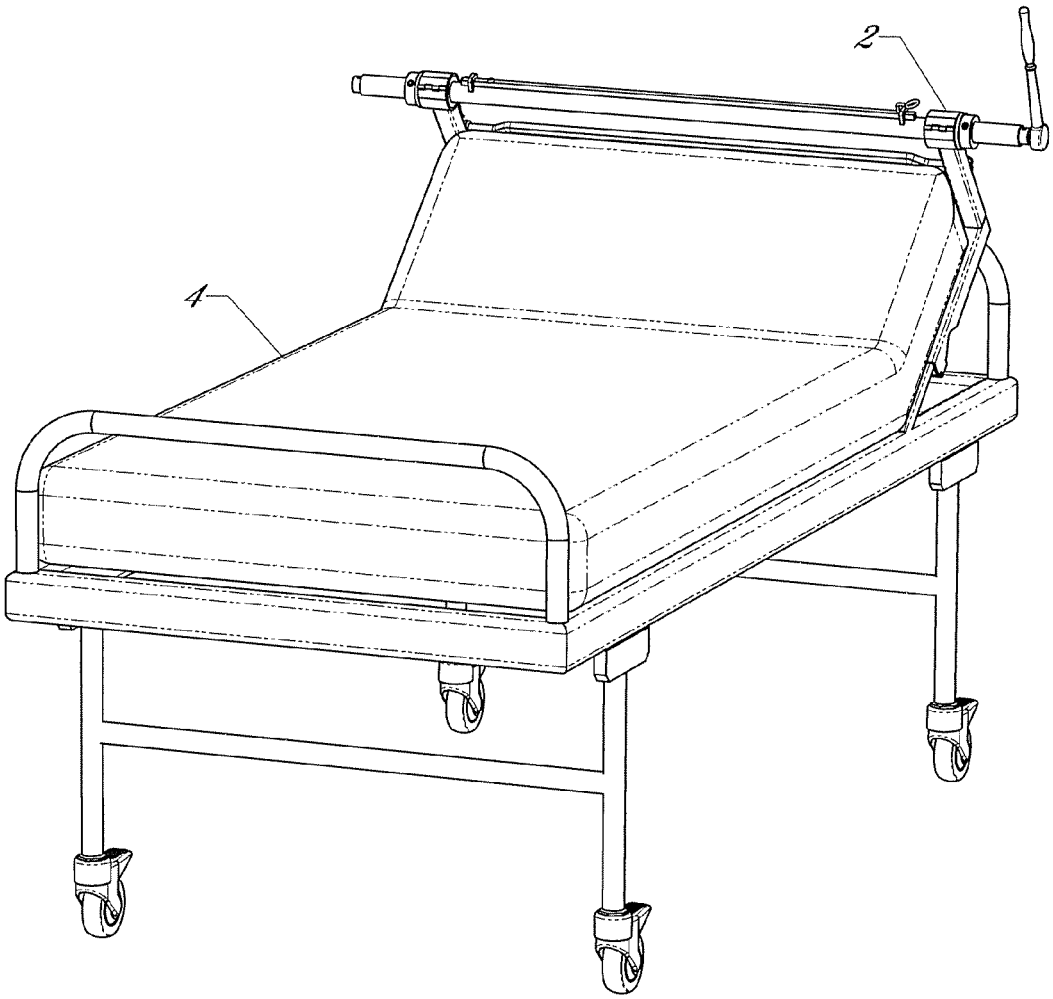
FIG. 2 is a front perspective view of one embodiment of the present invention interconnected to a hospital bed.
Figure 3:
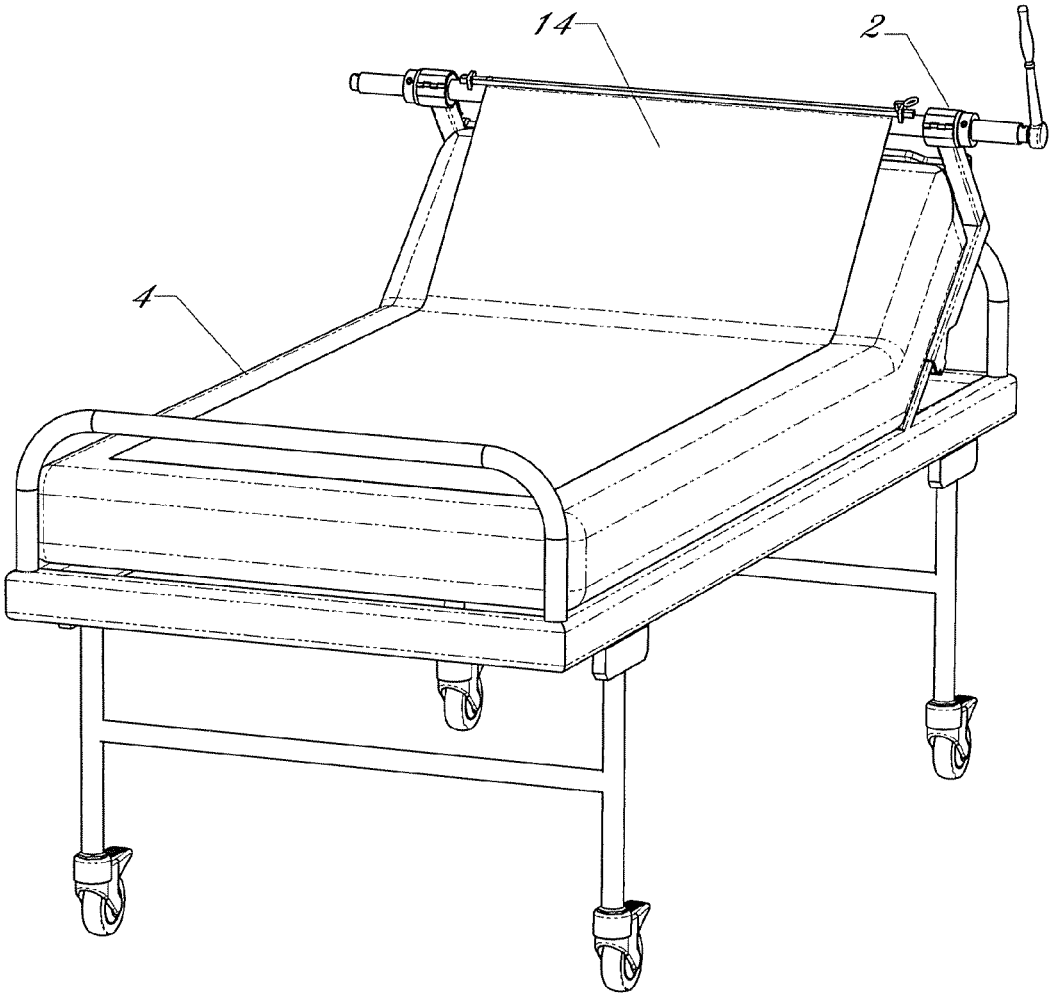
FIG. 3 is a front perspective view of one embodiment of the present invention interconnected to the hospital bed with bedding interconnected to a crossbeam.
Figure 4:
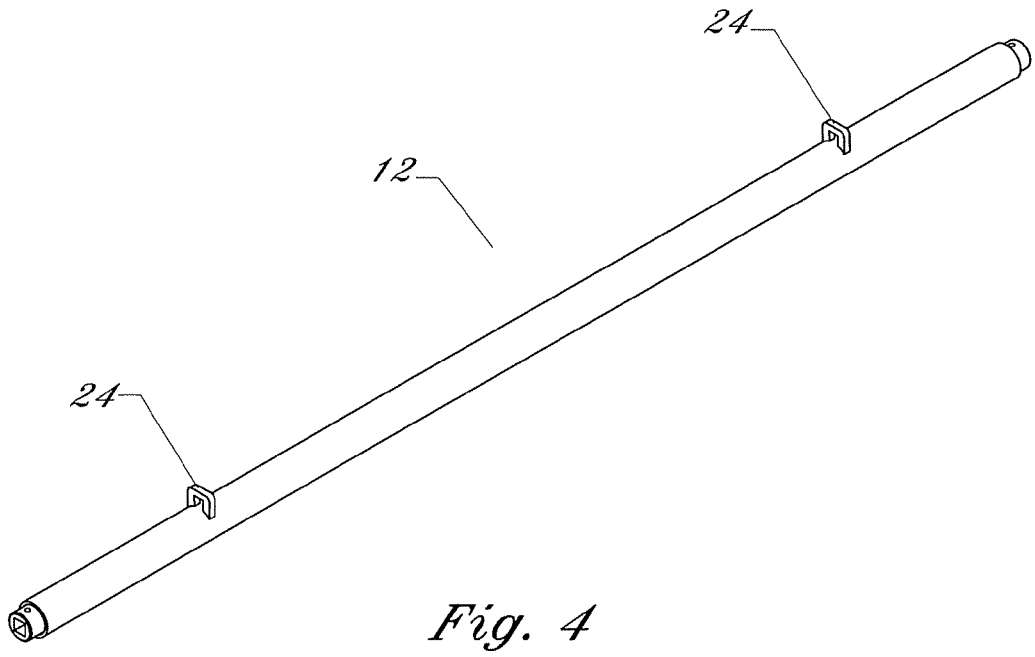
FIG. 4 is a perspective view of one embodiment of the crossbeam.
Figure 5:
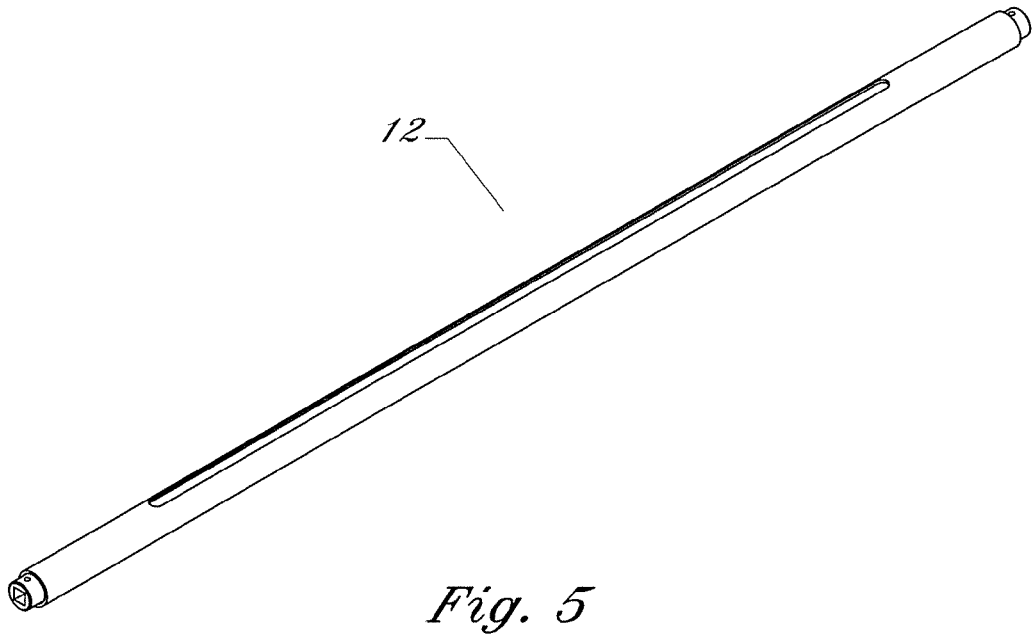
FIG. 5 is a perspective view of another embodiment of the crossbeam with a notch or groove integrated therein.
Figure 6:
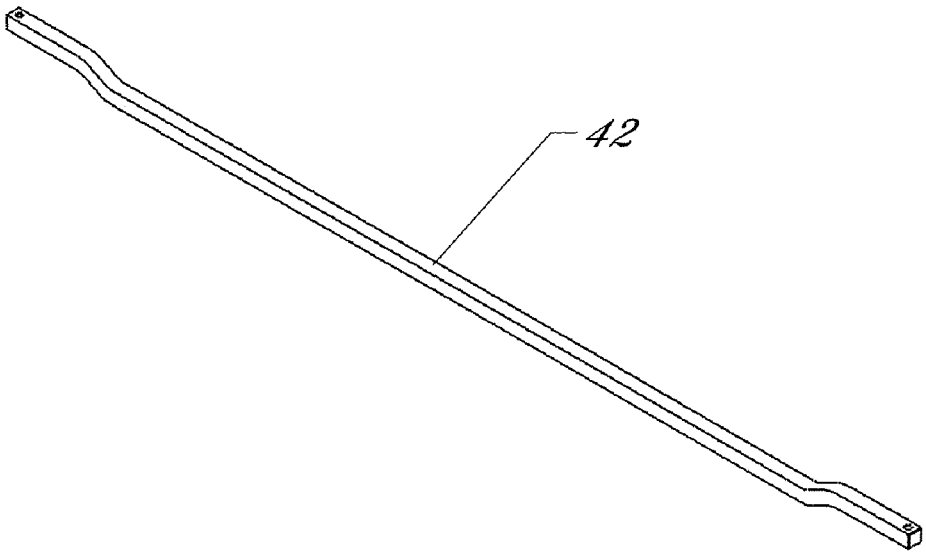
FIG. 6 is a front perspective view of one embodiment of a safety cross beam.

To assist in the understanding of the present invention the following list of components and associated numbering found in the drawings is provided herein:

| Component | # |
|---|---|
| Repositioning device | 2 |
| Hospital bed | 4 |
| Vertical support | 6 |
| First prong | 8A |
| Second prong | 8B |
| Bushing | 10 |
| Cross beam | 12 |
| Bedding material | 14 |
| Second cross beam | 18 |
| Ratchet | 20 |
| End cap | 22 |
| Arch | 24 |
| Handle | 26 |
| Connector end | 27 |
| Hinge | 28 |
| Latch | 30 |
| Opened end | 32 |
| Vertical support main body | 34 |
| Shaft | 36 |
| Pin | 38 |
| Set screw | 40 |
| Safety cross beam | 42 |

It should be understood that the drawings are not necessarily to scale. In certain instances, details which are not necessary for an understanding of the invention or which render other details difficult to perceive may have been omitted. It should be understood, of course, that the invention is not necessarily limited to the particular embodiments illustrated herein.

DETAILED DESCRIPTION

Referring now to FIGS. 1–13, the present invention is directed to the goal of facilitating the repositioning of a patient. One embodiment of the present invention involves interconnection of the repositioning device 2 to any standard hospital bed 4. In one embodiment, two vertical supports 6 are attached to the top corners of a bed frame by a two prong 8 vertical support 6 system. At the end of each vertical support 6 a bushing 10, in one embodiment nylon, facilitates the connection of a crossbeam 12 and provides substantially silent rotation. The crossbeam 12 is fed through the bushings 10 of the vertical supports 6. This crossbeam 12 creates a rotational surface upon which bedding material 14 is wound to facilitate repositioning of the patient. To create the rotation of the crossbeam 12 a ratcheting mechanism 24 is interconnected to at least one end of the crossbeam 12. Preferably, a standard ratchet 20 is used to create the rotational force necessary to wind the bedding materially thus moving the patient.

In operation, a sheet of bedding material 14, preferably the length of the bed 4 or longer, is placed at the foot of the bed 4. The bedding material is then drawn up to and interconnected to the crossbeam 12. In one embodiment of the invention, the bedding material 14 is interconnected to the crossbeam 12 by a second crossbeam 18 that is substantially parallel to the crossbeam 12. The second crossbeam 18 functions to pinch, or otherwise fasten or hold the bedding material 14 to the primary crossbeam 12. Other bedding connecting means can, however, be utilized, including VELCRO™ hook and loop attachments, snaps, clips, latches, buttons, felt, etc. without departing from the scope of the invention Once the bedding material 14 is laid out across the bed 4 and attached to the crossbeam 12, a patient can be placed thereon. This is accomplished, in one embodiment of the present invention, by facilitating desired movement of the underlying bed sheet. If, for example, a patient begins to slide down an inclined bed surface he or she may be repositioned by attaching the ratchet 20 to the crossbeam 12. The ratchet 20 may then be operated (preferably about ¼ to ½ rotational strokes) to wind the bedding material 14 around the crossbeam 12. The rotation will cause the bedding material 14 to be wrapped around the crossbeam 12 thus pulling the patient along with the bed sheet 14 towards the top of the bed frame. The process may be repeated until there is no more bedding material to be wound.

Several advantages are achieved using the present invention. Unlike prior art devices, after the present device 2 has been attached to the frame of the bed 2, the bed can be placed flush against a wall of a hospital room. The ratchet attachment 20 allows for the crossbeam 12 to be rotated in a confined area, more specifically, the ratcheting function allows the user to turn the crossbeam 12 without a full turn of the ratchet 20. The advantages of the savings of space, allowing for a bed 4 to be flush against the wall, and the leverage that a ratchet 20 provides in winding the bedding material 14 are neither taught nor suggested in the prior art. The ratchet lever 20 can be removed when not in use to facilitate further space limitations functional and aesthetic concerns, etc.

A further embodiment of the current invention provides for a ratchet 20 to be replaced by a small motor that functions to turn the crossbeam 12 to wind the bedding material 14. In each of the listed embodiments, the mechanical advantage of using such a motor includes the ability of a single caregiver operator to reposition a patient more efficiency and with less physical exertion. In addition, utilization of the present invention requires little training or skill. In still further embodiments, utilizing either the mechanical ratchet 20 itself or a motorized ratchet mechanism, the patient can themselves operate the ratchet 20 and/or motorized ratchet mechanism in order to reposition themselves upward in the bed 4 by causing rotation of the bedding material 14 around a crossbeam 12, thereby pulling their bodies into a desired position. The motorized version may be appropriately provided with limitations, such as a limit on the speed or degree of rotation so that undue rotation cannot occur. For example, a limitation of rotation of no more than 10 inches of bedding material 14 at any given time can be provided on a motorized embodiment to eliminate the possibility that a patient would inadvertently cause rotation of the bedding material 14 causing undesired movement. An emergency stop may also be provided to eliminate any undesired movement of the bedding material 14 in the mechanized/motorized version. In embodiments utilizing a mechanical ratchet assembly, the ratchet handle may be configured so that a patient may manually adjust the rotation of the crossbeam 12. Such handles may, therefore, be of any desired length or articulated in a fashion to facilitate physical manipulation by the patient when in a prone or partially sitting position.

Each of the two vertical supports 6 interconnect to the corners of a bed frame 4 by the use of a first prong 8A and second prong 8B. The first prong 8A and second prong 8B may be adapted to allow the vertical support 6 to be interconnected to circular or flat bed frames using rounded or flat first prongs 8A and second prongs 8B. Once interconnected to the bed frame 4 the primary crossbeam 12 is passed through the bushing 10 of the first vertical support and towards the second vertical support. Fixable end caps 22 are then secured onto each end of the crossbeam 12 to secure their positions to the vertical supports 6. The fixable end caps 22 allow for the crossbeam 12 to be secured into position but allows for free rotation. The ratchet 20 may be interconnected at either end of the crossbeam 12 with a set screw, weld, bolt, adhesive, or otherwise. Once the ratchet 20 is interconnected the operator can then rotate the ratchet 20 to wind up the bedding 14. Bedding material 14 is preferably interconnected to the crossbeam 12 by placing the bedding material 14 across the crossbeam 12 and placing the secondary crossbeam 18 through a plurality of arches 24 on the crossbeam 12 to secure the bedding 14. A handle 26 on the secondary crossbeam 18 or other suitable device may be employed to guide it into the arch 24.

With reference to FIGS. 7–13, another embodiment of the invention allows for the attachment of the vertical supports 6 to a rounded bed frame using the first prong 8A and second prong 8B of the vertical support 6 to receive and attach to rounded bed frame. Accordingly the prongs may be modified to be secured to a flat bed frame.

Another embodiment of the invention utilizes adjustable vertical supports 6. A main body 34 of the vertical support may be designed to slidingly interconnect to a shaft 36. This embodiment of the invention provides adjustment to the vertical supports 6, thus allowing the height of the crossbeam 12 to be selectively altered. Once the main body 34 of the vertical support is interconnected to the shaft 36 and the desired height adjusted, it is maintained by releasing the spring set pin 38, or alternatively the tightening of a set screw 40, to the shaft 36. This embodiment may also be used as an alternative to the embodiment that utilizes a hinge and latch system, as described below, for removal of the vertical supports.

The vertical supports 6 and the crossbeam 12 are preferably made of material that provide desired structural support, such as steel, aluminum, composites, or high density plastic. One embodiment uses steel castings for the vertical supports 6, caps 22, ratchet 20, socket, and primary 12 and secondary 18 crossbeams.

The diameter of the crossbeam 12 may be adjusted and/or selected along with the size and type of the bushings 10 to accommodate desired bedding material 14. A smaller diameter crossbeam 12 along with smaller bushings 10 and sockets results in a more precise rotation for smaller movements of the bedding material 14, since it may be desirable that the patient be only moved in small increments. A larger diameter crossbeam 12 may be employed when bedding 14 is required to be wound in larger increments. More specifically, a larger crossbeam 12 (including a larger bushing set and socket) will provide greater winding of material per each turn of the ratchet. This larger diameter allows the bedding material 14 to be taken up quickly allowing for the patient caregiver to quickly move the patient. With specific reference to FIG. 5, another embodiment of the invention employs a crossbeam with a slot that allows for bedding material 14 to be inserted therein before it is wound. This configuration allows the caregiver to dispense with any specialized bedding material 14 that includes attachments, or for the bedding material to be attached by a secondary crossbeam 18 (described in detail below). One embodiment of the present invention uses a primary crossbeam 12 that is approximately 1.5 inches in diameter, but diameters of 3 inches, 5 inches, or even 7 to 12 inches may also be employed without departing from the scope of the invention.

Bedding material 14 may be interconnected to the primary crossbeam 12 in various ways. In a preferred embodiment a standard bed sheet is interconnected by pinching the bed sheet between primary 12 and secondary 18 crossbeams. However, the secondary crossbeam 18 may be eliminated if different bedding material is employed and/or a slotted crossbeam is used. Bedding material can be interconnected with Velcro™, with clips, inserted into the crossbar directly, taped, snapped, or even tied to the primary crossbeam. One skilled in the art will appreciate that any method that will secure the bed sheet to the primary crossbeam 12 such that the rotation thereof causes accumulation of bedding material 14 on the crossbeam 12 is within the scope of the invention.

Another embodiment of the invention provides for the use of different types of bedding material 14 to be attached to the primary crossbeam 12. Suitable types of bedding material 14 used can be customized and adapted for use with the present invention in accordance with the type of patient that will be cared for. For example a burn patient may require softer bedding material than a standard bed sheet. A softer bedding material 14 may be placed underneath the patient and attached to the primary crossbar 12 to be wound. If bariatric patients are being cared for, heavy duty bedding material 14 may be used to aid in creating more force in the rotation of the bedding material around the primary crossbar 12. Bedding material 14 may also be modified to accommodate the amount of friction desired underneath the patient when they are repositioned longitudinally in bed 4. For example, a standard bed sheet may be coated with Teflon™ or smooth rubber on one side to create a lower frictional surface between the bed sheet and the actual surface of the bed. The coating of the bed sheet may also provide a secondary benefit of preventing absorption of fluids into the bed below. Other sheets that facilitate retention of a drier top surface may also be employed.

A standard size ratchet 20 is preferred for the design and construction of the ratchet system, however, different sized ratchets may be used to accommodate different diameter sizes of the primary crossbeam. The ratchet 20 may be integrated with the primary crossbeam 12 so that the caregiver does not need to transport the ratchet 20. The integrated ratchet 20 may have a handle that is foldable by adding a joint thereon. A telescoping handle may also be used to conceal the handle when not in use. Instead of a handle, a ratcheted knob or wheel system may be used to save more space. In one embodiment of the present invention, ratchets may be interconnected at either end of the primary crossbeam 12. Two ratchets at each end of the crossbeam 12 may be interconnected simultaneously and operated by two caregivers to increase the amount of leverage to wind the bedding material 14.

The ratchet may also be associated with a small motor. The motor may be placed on either or both ends of the primary crossbeam 12. The motor may be electrically powered and can be operated by a switch to wind the bedding material 4. Such switch being positionable for access to the patient if desired. The motor provides additional power and leverage in winding the bedding material 14. The motor system also allows for the attachment of a remote operating system wherein the motor is associated with a wired or wireless control unit. The control unit may be activated remotely at a nursing station or can be activated directly by the patient when repositioning is desired. The control unit may also be programmable allowing for patients to be repositioned by a predetermined schedule that can be inputted into the control unit to automatically wind bedding material 14 at desired times, durations, etc.

The invention may be modified to fit many different sizes of beds 4 or chairs. A primary crossbeam 14 of increased length (or a telescoping design) may be used to accommodate a wider bed. The invention may be operated without the end screw-lock caps and with a longer primary crossbeam to accommodate the size difference. For exceptionally wide beds, a third open, spring loaded, center support may be used to give additional support to the primary crossbeam 12. The third support allows for free rotation of the bedding material around the primary crossbeam while still maintaining support in the middle of the crossbeam 12.

In other embodiments, crossbeams 12 may be reconfigured and placed at different locations of the bed 4. For example the unit may be placed at the foot of the bed 4 to reposition a patient downward to the foot of the bed 4. Units may be placed simultaneously at the head and foot of the bed, thus allowing a caregiver to precisely adjust the position of the patient by operating both units. The invention may also be reconfigured to be placed on the side of the bed 4 to allow for lateral repositioning of the patient.

In one embodiment, a one piece primary crossbeam 12 is used. The primary crossbeam 12 may also consist of multiple pieces that can be interconnected. The primary crossbeam 12 assembled as a set of small pieces allows for the device 2 to be packaged into a smaller box. Similarly to the crossbeam 12, the vertical support 6 units may be made as smaller pieces that may be interconnected by screws or clips to create a more portable unit or a unit that included selective height adjustments.

Figure 7A:
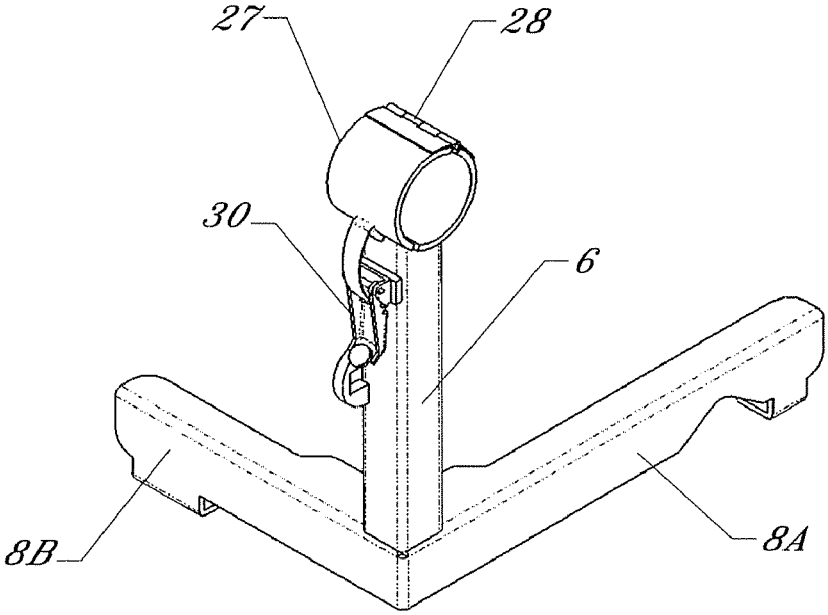
FIG. 7A is a perspective view of one embodiment of a vertical support of the present invention with a selectively openable connector end.
Figure 7B:
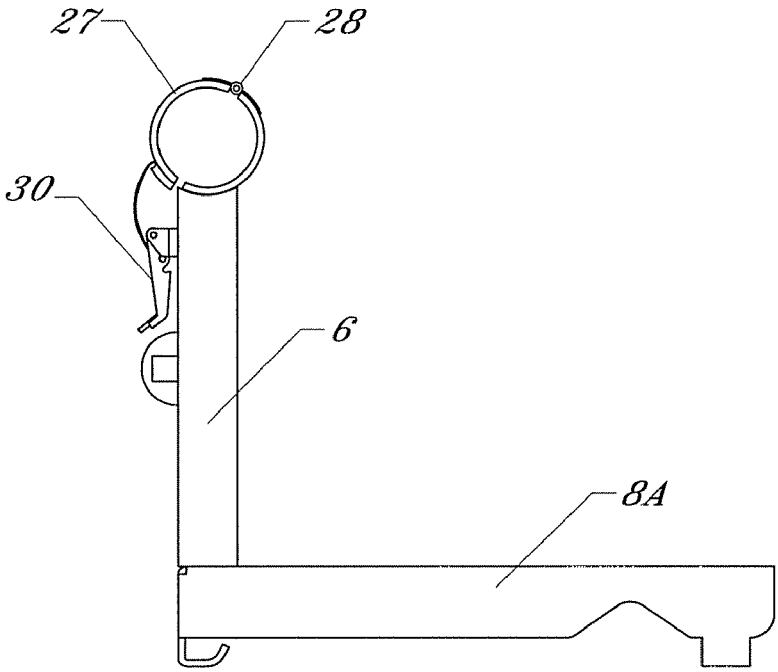
FIG. 7B is a front elevation view of the vertical support shown in FIG. 7A.
Figure 8A:
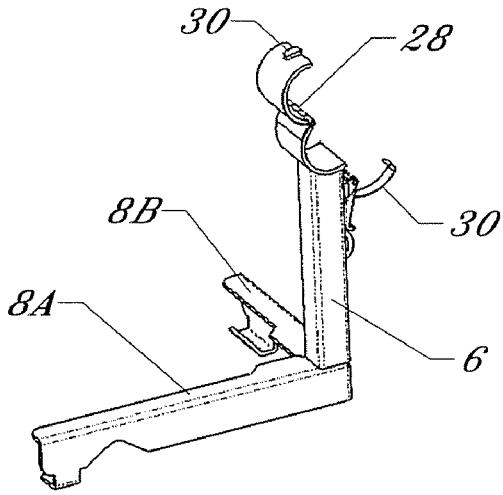
FIG. 8A is the connector end shown in FIG. 7 in an open position.
Figure 8B:
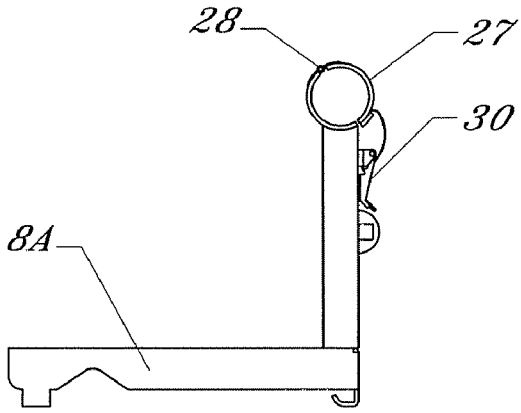
FIG. 8B is the connector end shown in FIG. 8A in a closed and latched position.
Figure 8C:
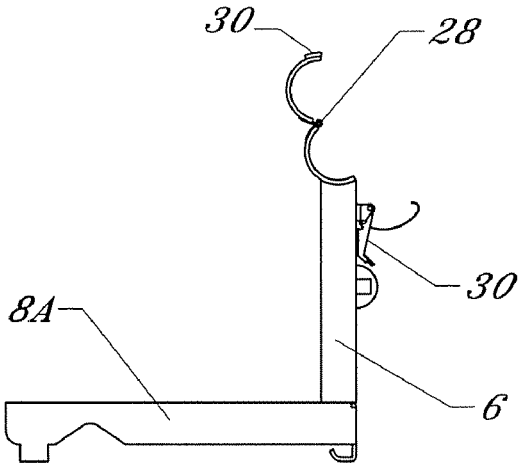
FIG. 8C is a front elevation view of the connector end shown in FIG. 8A.
Figure 9A:
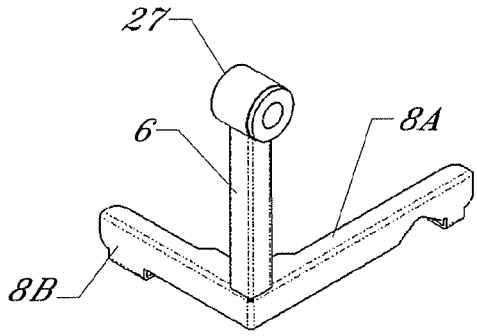
FIG. 9A is a perspective view of an alternate embodiment of the vertical support employed in the present invention.
Figure 9D:
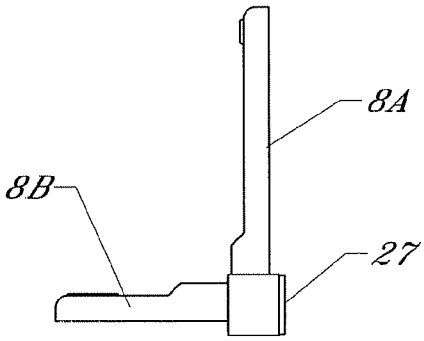
FIG. 9D is a top plan view of the vertical support shown in FIG. 9A.
Figure 9C:
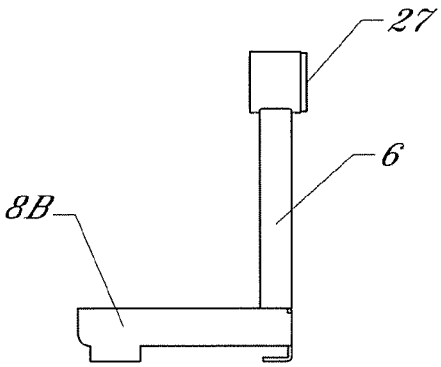
FIG. 9C is a left elevation view of the vertical support shown in FIG. 9A.
Figure 9B:
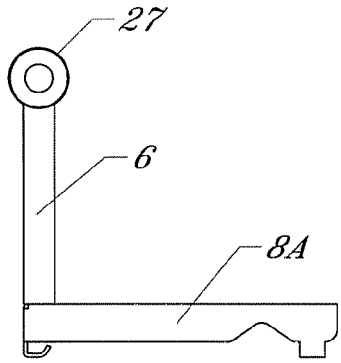
FIG. 9B is a front elevation view of the vertical support shown in FIG. 9A.
Figure 10A:
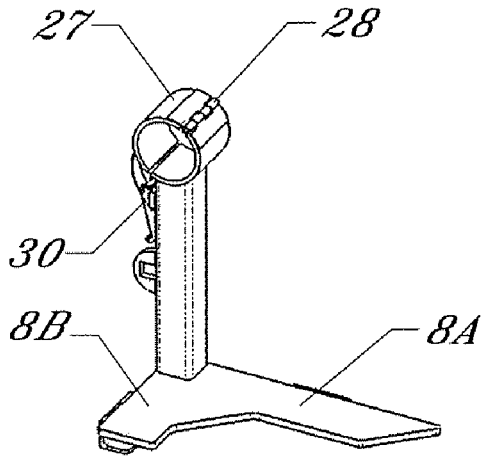
FIG. 10A is an alternate embodiment of the vertical support.
Figure 10B:
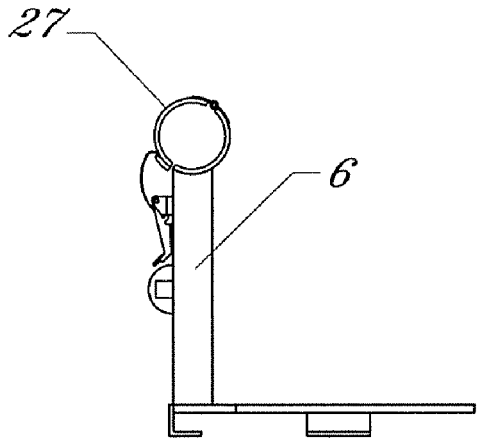
FIG. 10B is a front elevation view of the vertical support shown in FIG. 10A.
Figure 11A:
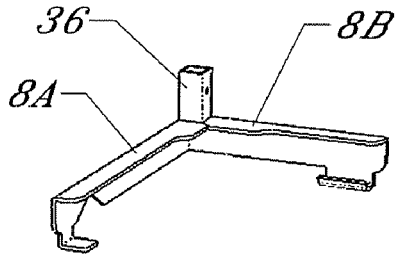
FIG. 11A is perspective view of a base portion of an adjustable vertical support.
Figure 11B:
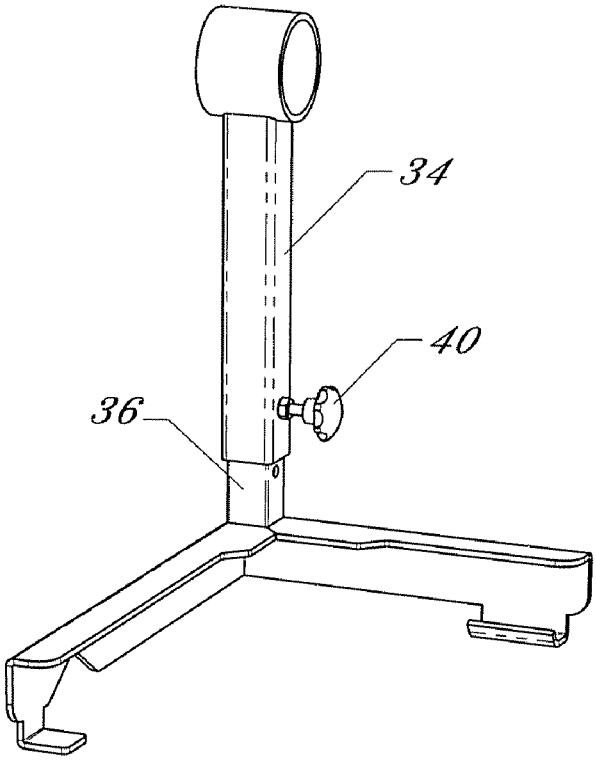
FIG. 11B is a perspective view of a vertical support main body interconnected to the base
Figure 12A:
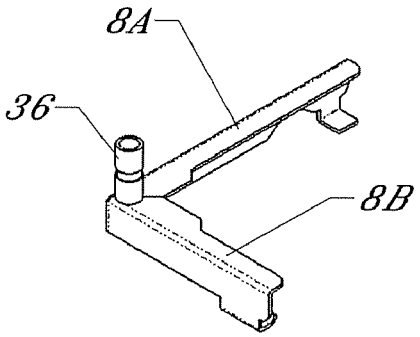
FIG. 12A is a perspective view of an alternate base portion of an adjustable vertical support.
Figure 12C:
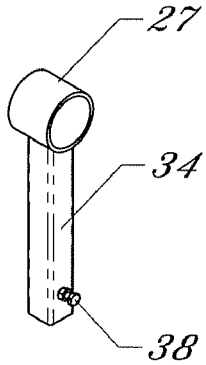
FIG. 12C is a perspective view of one embodiment of the vertical support main body
Figure 12B:
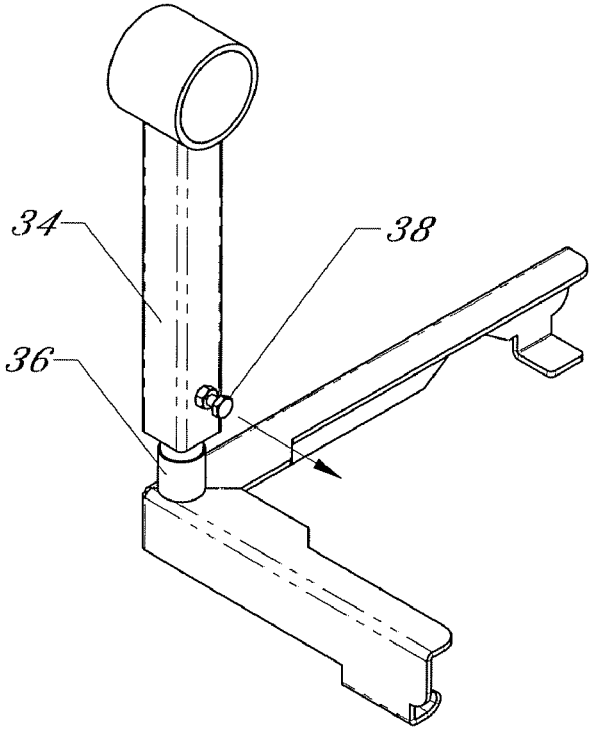
FIG. 12B is a perspective view of an alternate vertical support main body interconnected to the base.

Referring specifically now to FIGS. 7, 8 and 10, another embodiment of the invention allows for quick removal of the crossbeam 12 from a connector end 27 of the vertical supports 6. This embodiment is achieved through the use of a hinge 28 attached to the vertical support 6 and latch 30 that selectively opens and closes the connector end. The connector ends 27 of the vertical supports 6 in this embodiment have been cut into substantially equal halves wherein the hinge 28 operably interconnects the two halves together. The hinge 20 is interconnected, preferably, to allow the connector ends 27 to open upwards and facing away from the patient's head. In the closed position, the portion of the connector end 27 closest to the vertical support 6 is secured by the latch 30. The latch 30 is interconnected to the back end portion of the vertical support 6, thereby oriented away from the patient's head. The loop of the latch 30 holds the upper end of the connector end 27 by pulling down on a half-moon shaped piece of material extended from the top end of the connector 27. In an emergency the latches 30 may be opened and the crossbeam 12 removed. The hinge 28 and latches 30 are attached so that when the connector end 27 is opened the crossbeam 12 may be removed away from the patient's head.

Figure 13A:
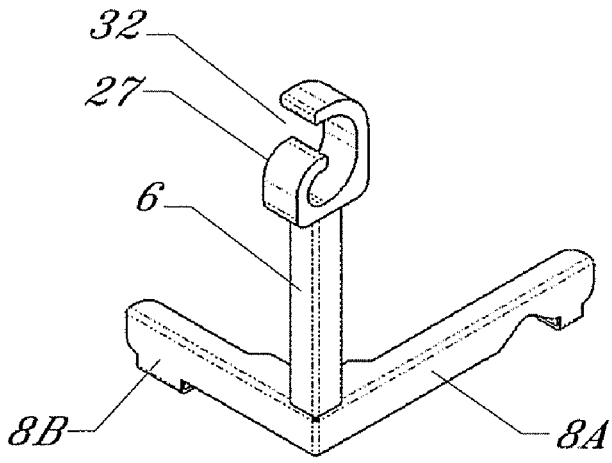
FIG. 13A is a perspective view of an alternate embodiment of a vertical support.
Figure 13B:
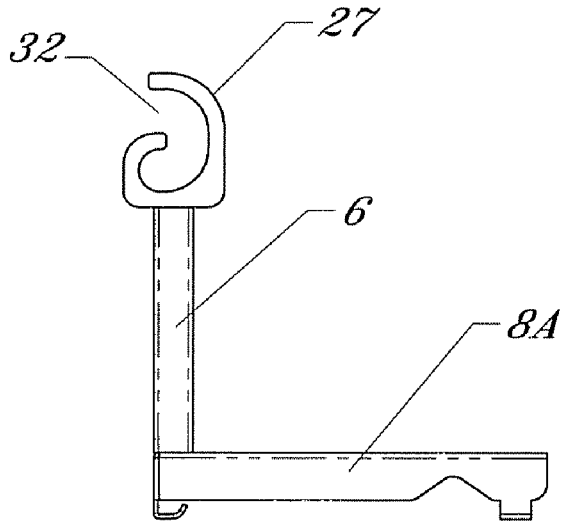
FIG. 13B is a front elevation view of the vertical support shown in FIG. 13A.

Referring specifically now to FIG. 13, other embodiments of the present invention employ a C-shaped open ended connector 27. This connector end 27 has an open end 32 allowing the primary crossbeam to enter and rest on a portion of the connector 27 that is contoured to receive the main crossbeam. This embodiment allows for the quick removal of the crossbeam without the use of latches or hinges. The generally C-shaped connector end 27 may include bushings integrated therewith. In the event of an emergency, the crossbeam 12 may be removed quickly away from the head (or foot) of the bed. If the bedding interconnected to the crossbeam 12 does not have enough slack, the operator may rotate the crossbeam 12 to clear the generally C-shaped connector.

Another embodiment of the invention utilizes a safety crossbeam 42 to further interconnect the two vertical supports 6. The advantage of utilizing the safety crossbeam 42 is to prevent a patient from sliding between the crossbeam 12 and the patient's bed. This embodiment of the invention may use a safety crossbeam that is permanently interconnected or a safety crossbeam 42 that is selectively secured with a cotter pin or similar device, thus allowing the safety crossbeam 42 to be removed in an emergency.

While various embodiments of the present invention have been described in detail, it is apparent that further modifications and adaptions of the present invention will occur to those skilled in the art, it is to be expressly understood, however, that such modifications and adaptations are within the spirit and scope of the present invention as described and as set forth in the following claims.

What is claimed is:

1. A patient repositioning apparatus comprising:

a first vertical support with a bed frame interconnection end and a connector end with a bushing, said connector end is substantially cylindrical with a first arcuate segment and a second arcuate segment that are operably interconnected on one end and selectively interconnectable on the other end;

a second vertical support with a bed frame interconnection end and a substantially cylinder connector end with a bushing, said connector end is substantially cylindrical with a first arcuate segment and a second arcuate segment that are operably interconnected on one end and selectively interconnectable on the other end;

a first crossbeam operatively interconnected to said bushing of said first vertical support connector end and to said bushing of said second vertical support end, wherein said first crossbeam is adapted for securing bedding material; and a ratcheting mechanism operably interconnected to said crossbeam, said ratcheting mechanism capable of imparting selective crossbeam rotation thereby winding the bedding material therearound.

2. The apparatus of claim 1, wherein said bushings are substantially comprised of nylon, fluoropolymer resin, such as the one sold under the Trademark of Teflon, Polytetrafluoroethylene, or plastic.

3. The apparatus of claim 1, wherein said first crossbeam includes a first end and a second end, said first and second ends being configured to receive an end cap that operably interconnects said first crossbeam to said first vertical support and said second vertical support and allows for free rotation of said crossbeam.

4. The apparatus of claim 1, further comprising a second crossbeam interconnected to said first crossbeam and adapted to secure bedding material to said first crossbeam.

5. The apparatus of claim 1, wherein said connector end of said first vertical support and said connector end of said second vertical support include an opening for receiving said first crossbeam, said connector ends also having surfaces to allow said first crossbeam to rest.

6. A patient repositioning apparatus comprising:

a first vertical support with a bed frame interconnection end and a connector end, wherein said connector end has a first half and a second half that are hingedly interconnected;

a second vertical support with a bed frame interconnection end and a connector end, wherein said connector end has a first half and a second half that are hingedly interconnected;

a first crossbeam operatively associated with said first vertical support connector end and said second vertical support connector end, wherein said first crossbeam is adapted to accept bedding material; and a ratchet mechanism operably interconnected to said crossbeam, said ratchet mechanism imparting selective crossbeam rotation to wind the bedding material therearound.

7. The apparatus of claim 6, further comprising a second crossbeam interconnected to said first crossbeam and adapted to connect the bedding material to said first crossbeam.

8. The apparatus of claim 6, wherein the free ends of said first halves and said second halves of said first vertical support and said second vertical support may be selectively interconnected with one or more of a latch, a clasp, a magnet, a screw, a bolt, a tie, a hook and loop fastener, and a snap.

9. The apparatus of claim 6, wherein said first vertical support is further interconnected to said second vertical support by a safety crossbeam.

10. The apparatus of claim 6, wherein said bed frame interconnection ends of said first vertical support and said second vertical support include a flange for interconnection to a bed frame.

11. The apparatus of claim 6, wherein said ratchet mechanism is electrically powered.

12. The apparatus of claim 5, wherein said first vertical support and said second vertical support can be removed from said bed frame interconnection ends thereof.

13. A method for longitudinally repositioning a patient, comprising:

interconnecting bedding material to a crossbeam;

laying a patient down on said bedding material; and rotating said crossbeam wherein said bedding material is wound around said crossbeam, thus selectivity transitioning said patient from a first location to a second location, said crossbeam being supported by at least one vertical support adapted to be adjustable to selective heights, said vertical support having a first half and a second half that are hingedly interconnected.

14. The method of claim 13, wherein said rotation is facilitated by a ratchet.

* * * * *